US010876180B2

(12) United States Patent
Kami et al.

(10) Patent No.: US 10,876,180 B2
(45) Date of Patent: Dec. 29, 2020

(54) METHOD OF MANUFACTURING HOT ROLLED STEEL SHEET FOR SQUARE COLUMN FOR BUILDING STRUCTURAL MEMBERS

(71) Applicant: JFE Steel Corporation, Tokyo (JP)

(72) Inventors: Chikara Kami, Chiba (JP); Yuta Tamura, Fukuyama (JP); Takato Tamai, Kurashiki (JP); Shuji Kawamura, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 248 days.

(21) Appl. No.: 15/620,957

(22) Filed: Jun. 13, 2017

(65) Prior Publication Data

US 2017/0275720 A1 Sep. 28, 2017

Related U.S. Application Data

(62) Division of application No. 14/391,899, filed as application No. PCT/JP2012/060526 on Apr. 12, 2012, now Pat. No. 9,708,680.

(51) Int. Cl.
*C21D 8/02* (2006.01)
*C21D 9/46* (2006.01)
(Continued)

(52) U.S. Cl.
CPC ..... *C21D 8/0263* (2013.01); *C21D 6/005* (2013.01); *C21D 6/008* (2013.01); *C21D 8/0226* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *E04C 3/32* (2013.01); *C21D 2211/005* (2013.01); *C21D 2211/009* (2013.01)

(58) Field of Classification Search
None
See application file for complete search history.

(56) References Cited

U.S. PATENT DOCUMENTS

2008/0118390 A1* 5/2008 Kizu ..... C21D 8/0205 420/85
2012/0295123 A1* 11/2012 Abe ..... C21D 8/0263 428/544
2013/0186526 A1 7/2013 Nakamura et al.

FOREIGN PATENT DOCUMENTS

CA 2 787 564 A1 7/2011
JP 03-219015 A 9/1991
(Continued)

OTHER PUBLICATIONS

Supplementary European Search Report dated Nov. 13, 2015 in corresponding European Application No. 12874301.0.
(Continued)

*Primary Examiner* — Xiaowei Su
(74) *Attorney, Agent, or Firm* — DLA Piper LLP (US)

(57) ABSTRACT

A method of manufacturing a hot rolled steel sheet for a square column for building structural members includes a hot rolling step, a cooling step, and a coiling step performed on a steel to form a hot rolled steel sheet, wherein the steel has a composition containing, in terms of % by mass, C: 0.07 to 0.18%, Mn: 0.3 to 1.5%, P: 0.03% or less, S: 0.015% or less, Al: 0.01 to 0.06%, N: 0.0006% or less, and the balance being Fe and unavoidable impurities.

11 Claims, 4 Drawing Sheets

20 μm

(51) Int. Cl.

| | |
|---|---|
| ***C21D 6/00*** | (2006.01) |
| ***C22C 38/12*** | (2006.01) |
| ***C22C 38/00*** | (2006.01) |
| ***C22C 38/02*** | (2006.01) |
| ***C22C 38/14*** | (2006.01) |
| ***C22C 38/06*** | (2006.01) |
| ***C22C 38/04*** | (2006.01) |
| ***E04C 3/32*** | (2006.01) |

(56) References Cited

FOREIGN PATENT DOCUMENTS

| | | | | |
|---|---|---|---|---|
| JP | 08-246095 | A | 9/1996 | |
| JP | 09-118952 | A | 5/1997 | |
| JP | 10-280088 | A | 10/1998 | |
| JP | 11-092858 | A | 4/1999 | |
| JP | 11-158581 | A | 6/1999 | |
| JP | 2001-303168 | A | 10/2001 | |
| JP | 2002-241897 | A | 8/2002 | |
| JP | 2008-007833 | A | 1/2008 | |
| WO | 2005/028693 | A1 | 3/2005 | |
| WO | WO-2011090205 | A1 * | 7/2011 | ..... C21D 8/0263 |
| WO | 2011/115279 | A1 | 9/2011 | |

OTHER PUBLICATIONS

Canadian Office Action dated Feb. 5, 2016 in corresponding Canadian Application No. 2,869,700.
Office Action dated Mar. 12, 2018, of counterpart European Application No. 12874301.0.

* cited by examiner

20 μm

METHOD OF MANUFACTURING HOT ROLLED STEEL SHEET FOR SQUARE COLUMN FOR BUILDING STRUCTURAL MEMBERS

TECHNICAL FIELD

This disclosure relates to a method of manufacturing a hot rolled steel sheet for a square column for building structural members. In particular, it relates to decreasing the yield ratio of and further improving the toughness of a square column manufactured by cold-rolling a hot rolled steel sheet as a raw material. The term hot rolled steel sheet is used to refer both a hot rolled steel sheet and a hot rolled steel strip.

BACKGROUND

A square column is typically manufactured through cold forming by using a hot rolled steel sheet (hot rolled steel strip) or plate as the raw material. Examples of the cold forming employed in manufacturing a square column include press forming and roll forming. When a square column is to be manufactured through roll forming using a hot rolled steel sheet as a raw material, it is a prevailing practice to first form a hot rolled steel sheet into a round steel pipe and then cold-form the round steel pipe into a square column. This method of manufacturing a square column through roll forming has an advantage of high productivity compared to a method of manufacturing a square column through press forming. However, according to the method of manufacturing a square column through roll forming, large work strain is introduced in the pipe axis direction as the sheet is formed into a round form. Moreover, during the process of cold-forming the round form into a square form, flat portions of the square column are subjected to bend-back forming in a direction opposite the direction in which bending into the round form had been performed. Accordingly, a square column manufactured through roll forming has a problem in that the yield ratio in the pipe axis direction tends to be high and the ductility and toughness tend to be degraded due to the Bauschinger effect or the like.

To address this problem, for example, Japanese Unexamined Patent Application Publication No. 08-246095 describes a method of manufacturing a steel material for a low-yield-ratio, high-toughness square column, the method including hot-rolling a steel at a heating temperature of 1150° C. to 1250° C. and finishing temperature of 800° C. to 870° C. and performing coiling at 500° C. to 650° C., the steel containing, in terms of % by weight, at least one selected from C: 0.03 to 0.25%, Si: 0.10 to 0.50%, Mn: 0.30 to 2.00%, P: 0.020% or less, S: 0.020% or less, O: 50 ppm or less, H: 5 ppm or less, Al: 0.150% or less, Ti: 0.050% or less, V: 0.100% or less, Nb: 0.080% or less, Zr: 0.050% or less, and B: 0.0050% or less, and N to satisfy the relationship $N \leq (1/5)\{(1/2)Al+(1/1.5)Ti+(1/3.5)V+(1/6.5)Nb+(1/6.5)Zr+B\}$.

Japanese Unexamined Patent Application Publication No. 03-219015 describes a method of manufacturing a square pipe with low yield ratio and good low-temperature toughness, in which a low-carbon steel pipe is heated to a temperature of $Ac_3$—250° C. to $Ac_3$—20° C., quenched at a cooling rate of 15° C./s or more, cold-formed into a square pipe, and tempered at 200° C. to 600° C. According to Japanese Unexamined Patent Application Publication No. 03-219015, post-intercritical-anneal quenching, cold-forming, and tempering are sequentially performed to eliminate the effect of work hardening occurred during pipe forming and thus a square pipe with low yield ratio and high toughness can be manufactured.

Japanese Unexamined Patent Application Publication No. 2002-241897 does not explicitly describe a steel sheet for a square column. However, a steel sheet having high formability and low yield ratio is described therein. The steel sheet described in Japanese Unexamined Patent Application Publication No. 2002-241897 contains, on a % by mass basis, C: 0.0002 to 0.1%, Si: 0.003 to 2.0%, Mn: 0.003 to 3.0%, and Al: 0.002 to 2.0%, one or more groups selected from Group 1 including B: 0.0002 to 0.01%, Group 2 including a total of 0.005 to 1.0% of at least one selected from Ti, Nb, V, and Zr, Group 3 including a total of 0.005 to 3.0% of at least one selected from Cr, Mo, Cu, and Ni, and Group 4 including Ca: 0.005% or less and a rare earth element: 0.20% or less, and, as impurities, P: 0.0002 to 0.15%, S: 0.0002 to 0.05%, and N: 0.0005 to 0.015%, in which a mean crystal grain diameter of a ferrite phase is more than 1 μm but not more than 50 μM, the volume ratio of the ferrite phase is 70% or more, the aspect ratio of the ferrite phase is 5 or less, 70% of ferrite grain boundaries are high-angle grain boundaries, and the mean crystal grain diameter of a second phase, whose volume fraction among the rest of the phase is maximum, is 50 μm or less. This steel sheet has little variation in yield strength and yield ratio.

WO 2005/028693 A1 describes a hot rolled steel sheet for processing. The hot rolled steel sheet described in WO2005/028693 A1 has a composition of, on a % by weight basis, C: 0.01 to 0.2%, Si: 0.01 to 0.3%, Mn: 0.1 to 1.5%, Al: 0.001 to 0.1%, and P, S, and N adjusted to a particular value or less, and has a microstructure including a polygonal ferrite primary phase and a hard second phase, the volume fraction of the hard second phase being 3 to 20%, the hardness ratio (hard second phase hardness/polygonal ferrite hardness) being 1.5 to 6, and the grain diameter ratio (polygonal ferrite grain diameter/hard second phase grain diameter) being 1.5 or more. According to WO 2005/028693 A1, a hot rolled steel sheet that obtains a BH amount of 60 MPa or more can be manufactured by introducing strain through pressing and by performing bake hardening, and a press-formed part having a strength comparable to that achieved by a 540-640 MPa-grade steel sheet can be stably manufactured from a 370-490 MPa-grade hot rolled steel sheet.

Japanese Unexamined Patent Application Publication No. 2001-303168 describes a method of manufacturing a steel sheet having a good brittle crack property. According to Japanese Unexamined Patent Application Publication No. 2001-303168, a steel sheet having a microstructure constituted by a ferrite structure and a pearlite structure and having a composition that satisfies C: 0.03 to 0.2%, Si: 0.5% or less, Mn: 1.8% or less, Al: 0.01 to 0.1%, and N: 0.01% or less is obtained by hot-rolling, and that steel sheet is subjected to first cooling that includes cooling a region 5 to 15% in terms of thickness from a front surface of the steel sheet and a region 5 to 15% in terms of thickness from a back surface of the steel sheet at an average cooling rate of 4 to 15° C./s to a temperature of 450 to 650° C. or less. Then, the steel sheet is recuperated to a temperature not more than the $Ar_3$ transformation temperature and subjected to second cooling at an average cooling rate of 1 to 10° C./s. As a result, the regions 5 to 15% in terms of thickness from the front surface and the back surface of the steel sheet come to contain fine ferrite grains with an equivalent circle mean diameter of 4 μm or less and an aspect ratio of 2 or less and the region 50 to 75% of the sheet thickness comes to contain fine ferrite grains with an equivalent circle mean diameter of 7 μm or less and an aspect ratio of 2 or less. Accordingly, a steel sheet having good COD properties, low-temperature toughness, and good brittle crack resistance can be obtained.

However, a steel material manufactured in Japanese Unexamined Patent Application Publication No. 08-246095 has a yield ratio of about 81 to 85% at the lowest and fails to achieve a low yield ratio of 80% or less. Moreover, the absorbed energy at 0° C. is sometimes less than 100 J. Thus, there is a problem in that high toughness cannot be stably achieved. According Japanese Unexamined Patent Application Publication No. 03-219015, two different types of heat treatment, namely, quenching after intercritical annealing and tempering, need to be performed and there is a problem in that the process is thus complicated, resulting in decreased productivity and increased manufacturing cost.

When a steel sheet described in Japanese Unexamined Patent Application Publication No. 2002-241897 is used as a raw material, formed into a round steel pipe, and cold-formed into a square column, the degree of cold working is high at the flat portions of the square column. Thus, there is a problem in that the square column may not always achieve sufficient toughness. When a steel sheet described in WO 2005/028693 A1 is used as a raw material, formed into a round steel pipe, and cold-formed into a square column, the degree of cold working is high at the flat portions of the obtained square column and thus there is a problem in that the yield strength and then the yield ratio are increased, and the toughness is decreased. Moreover, the hot rolled steel sheet described in WO 2005/028693 A1 is susceptible to strain aging and is thus not suitable as a raw material for manufacturing a square column by cold forming.

When a hot rolled steel sheet manufactured in Japanese Unexamined Patent Application Publication No. 2001-303168 is used and cold-formed into a square column, the yield strength of the square column obtained by cold forming increases and, as a result, the yield ratio increases, because the ferrite grains in this hot rolled steel sheet are fine. Accordingly, when a hot rolled steel sheet manufactured by the technology described in Japanese Unexamined Patent Application Publication No. 2001-303168 is used as a raw material, the resulting square column cannot achieve a low yield ratio of 80% or less needed for building structural members.

It could therefore be helpful to provide a hot rolled steel sheet suitable as a raw material for a square column for building structural members, the hot rolled steel sheet having strength of 215 MPa or more in terms of yield strength and 400 to 510 MPa in terms of tensile strength, a low yield ratio of 75% or less, and high toughness of 180 J or more in terms of absorbed energy in a Charpy impact test performed at a test temperature of 0° C. and preferably −30° C.

SUMMARY

We thus provide:

(1) A hot rolled steel sheet for a square column for building structural members, the hot rolled steel sheet having a composition of, in terms of % by mass,

| | |
|---|---|
| C: 0.07 to 0.18%, | Mn: 0.3 to 1.5%, |
| P: 0.03% or less, | S: 0.015% or less, |
| Al: 0.01 to 0.06%, | N: 0.006% or less, |

and the balance being Fe and unavoidable impurities, and having a microstructure that includes a primary phase constituted by ferrite and a second phase constituted by pearlite or pearlite and bainite, wherein a second phase frequency defined by equation (1) below is 0.20 to 0.42 and a mean crystal grain diameter of the primary phase and the second phase together is 7 to 15 μm.

Note

Second phase frequency=(Number of second phase grains intersecting line segments of particular length)/(Number of primary phase grains and second phase grains intersecting line segments of particular length) (1)

(2) The hot rolled steel sheet for a square column for building structural members described in (1), wherein, in addition to the composition, Si: less than 0.4% by mass is contained.

(3) The hot rolled steel sheet for a square column for building structural members according to (1) or (2), wherein, in addition to the composition, at least one selected from Nb: 0.015% or less, Ti: 0.030% or less, and V: 0.070% or less is contained in terms of % by mass.

(4) The hot rolled steel sheet for a square column for building structural members according to any one of (1) to (3), wherein, in addition to the composition, B: 0.008% by mass or less is contained.

(5) A method of manufacturing a hot rolled steel sheet for a square column for building structural members, the method including a hot rolling step, a cooling step, and a coiling step performed on a steel to form a hot rolled steel sheet, wherein the steel has a composition containing, in terms of % by mass,

| | |
|---|---|
| C: 0.07 to 0.18%, | Mn: 0.3 to 1.5%, |
| P: 0.03% or less, | S: 0.015% or less, |
| Al: 0.01 to 0.06%, | N: 0.006% or less, |

and the balance being Fe and unavoidable impurities, the hot rolling step includes heating the steel to a heating temperature of 1100 to 1300° C., rough-rolling the heated steel at a rough rolling end temperature of 1150 to 950° C. to form a sheet bar, and finish-rolling the sheet bar at a finish rolling start temperature of 1100 to 850° C. and a finish rolling end temperature of 900 to 750° C. to form a hot rolled sheet, the cooling step is started immediately after completion of the finish rolling and cooling is performed to a coiling temperature such that an average cooling rate in a temperature range of 750 to 650° C. in terms of surface temperature is 20° C./s or less, a time taken for a temperature at a sheet thickness center to reach 650° C. is within 35 s, and an average cooling rate in a temperature range of 750 to 650° C. at the sheet thickness center is 4 to 15° C./s, and the coiling step includes coiling the cooled steel sheet at a coiling temperature of 500 to 650° C. and allowing the coiled sheet to cool.

(6) A method of manufacturing a hot rolled steel sheet for a square column for building structural members, the method including a hot rolling step, a cooling step, and a coiling step performed on a steel to form a hot rolled steel sheet, wherein the steel has a composition containing, in terms of % by mass,

| | |
|---|---|
| C: 0.07 to 0.18% | Mn: 0.3 to 1.5%, |
| P: 0.03% or less, | S: 0.015% or less, |
| Al: 0.01 to 0.06%, | N: 0.0006% or less, |

and the balance being Fe and unavoidable impurities, the hot rolling step includes heating the steel to a heating temperature of 1100 to 1300° C., rough-rolling the heated steel at a rough rolling end temperature of 1150 to 950° C. to form a sheet bar, and finish-rolling the sheet bar at a finish rolling start temperature of 1100 to 850° C. and a finish rolling end temperature of 900 to 750° C. to form a hot rolled sheet, the cooling step is started immediately after completion of the finish rolling and includes three stages of cooling, which are first cooling, second cooling, and third cooling so that a time taken for a temperature at a sheet thickness center to reach 650° C. is within 35 s from the start of cooling, wherein the first cooling includes performing cooling so that a cooling end temperature is 550° C. or more in terms of surface temperature, the second cooling includes performing air cooling for 3 to 15 s after completion of the first cooling, and the third cooling includes performing cooling to a temperature of 650° C. or less at an average cooling rate of 4 to 15° C./s in a temperature range of 750 to 650° C. in terms of the temperature at the sheet thickness center after completion of the second cooling, and the coiling step includes coiling the cooled steel sheet at a coiling temperature of 500 to 650° C. and allowing the coiled sheet to cool.

(7) The method of manufacturing a hot rolled steel sheet for a square column for building structural members according to (5) or (6), wherein a total reduction of the finish rolling is 35 to 70%.

(8) The method of manufacturing a hot rolled steel sheet for a square column for building structural members according to (5) or (6), wherein, in addition to the composition of the steel, Si: less than 0.4% by mass is contained.

(9) The method of manufacturing a hot rolled steel sheet for a square column for building structural members according to (5) or (6), wherein, in addition to the composition of the steel, at least one selected from Nb: 0.015% or less, Ti: 0.030% or less, and V: 0.070% or less is contained in terms of % by mass.

(10) The method of manufacturing a hot rolled steel sheet for a square column for building structural members according to (5) or (6), wherein, in addition to the composition of the steel, B: 0.008% by mass or less is contained.

(11) The method of manufacturing a hot rolled steel sheet for a square column for building structural members according to (6), wherein fourth cooling is performed after completion of the third cooling in addition to the three stages of the cooling.

(12) A square column for building structural members, manufactured by cold-forming a raw material which is the hot rolled steel sheet according to any one of (1) to (4).

A hot rolled steel sheet for a square column for building structural members can be manufactured easily and at low cost at significant industrial advantage. A square column exhibiting strength of 295 MPa or more in terms of yield strength and 400 MPa or more in terms of tensile strength and a low yield ratio of 80% or less in a column axis direction, and high toughness of 150 J or more in terms of a Charpy impact test absorbed energy at a test temperature of −0° C. can be easily manufactured by cold-forming the hot rolled steel sheet.

DETAILED DESCRIPTION

The hot rolled steel sheet has the above-described properties and can be used as a raw material to manufacture a square column by cold forming, the square column exhibiting strength of 295 to 445 MPa in terms of yield strength and 400 to 550 MPa in terms of tensile strength and a low yield ratio of 80% or less in the pipe axis direction, and high toughness of 150 J or more in terms of an absorption energy in a Charpy impact test performed at a test temperature of 0° C. and preferably −30° C.

The "hot rolled steel sheet" discussed here refers to a hot rolled steel sheet having a sheet thickness of 6 mm or more and 25 mm or less.

We conducted extensive studies on the effects of various factors on the yield ratio and toughness of a square column manufactured by cold-forming a hot rolled steel sheet as a raw material. We found that the microstructure of the hot rolled steel sheet used as a raw material, in particular, the presence of a second phase, greatly affects the yield ratio and toughness of the square column manufactured by cold forming.

It has been said that in a multiphase microstructure constituted by a ferrite phase and a non-ferrite second phase, the presence of the second phase, which is hard and in which brittle cracks easily propagate compared to in ferrite, decreases the toughness. However, we found that the toughness cannot be satisfactorily evaluated based on the volume fraction of the second phase and the mean grain diameter of the second phase which are parameters that are usually used. This is because the second phase sometimes takes an aggregated form or, in other cases, exists along crystal grain boundaries and the second phase volume fraction and mean grain diameter significantly differ depending on the morphology of the second phase. If the effect of the second phase on toughness is evaluated based on the volume fraction and mean crystal grain diameter of the second phase, which are parameters typically used, then the effect of the second phase that exists along grain boundaries will be underestimated.

We further found that the effect of the second phase on the toughness and yield ratio of a square column manufactured by cold forming can be satisfactorily evaluated by using a second phase frequency of a hot rolled steel sheet used as the raw material and the mean grain diameter of the primary phase, which is ferrite, and the second phase together. The "second phase frequency" discussed here refers to a value obtained as follows.

Figure 1:
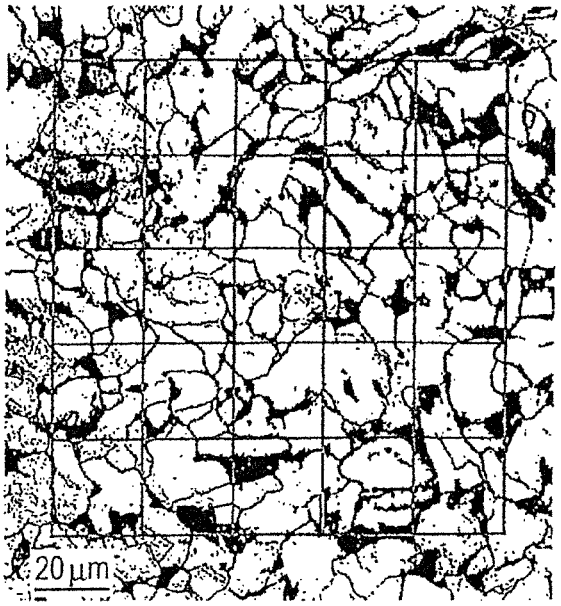
FIG. 1 is a diagram indicating one example of line segments used for measuring a second phase frequency.

First, the microstructure of a cross section (L cross section) taken in a rolling direction of a hot rolled steel sheet used as a raw material is photographed with an optical microscope or a scanning electron microscope. A particular number of line segments of a particular length are drawn in the rolling direction and in a sheet thickness direction on the obtained photograph of the microstructure, as shown in FIG. 1. The number of crystal grains that intersect the line segments is counted for each of the primary phase and the second phase. When an end of a line segment stays within a crystal grain, the count is 0.5. The ratio of the obtained total number of grains of the second phase intersecting the line segments (number of grains of second phase) to the obtained total number of grains of both phases intersecting line segments (total number of grains), i.e., (number of grains of second phase)/(total number of grains), is determined and the result is defined to be the second phase frequency. The length of each line segment may be appropriately determined in accordance with the size of the microstructure.

Experimental results will now be described. A slab (thickness: 230 mm) having a composition of, in terms of % by mass, 0.09 to 0.15% C-0.01 to 0.18% Si-0.43 to 1.35% Mn-0.017 to 0.018% P-0.0025 to 0.0033% S-0.031 to 0.040% Al-Balance Fe and unavoidable impurities was heated and soaked at 1200 to 1270° C., subjected to hot rolling that included rough rolling and finish rolling to form a hot rolled steel strip (thickness: 16 to 25 mm), and then coiled. Finish rolling was performed at a total reduction of 40 to 52% and a finish rolling end temperature of 750 to 850° C. Upon completion of finish rolling, accelerated cooling was performed. The coiling temperature was 550 to 600° C. and the steel strip was allowed to cool after being coiled.

The resulting hot rolled steel strip serving as a raw material was formed by cold-rolling into a round steel pipe and then the round steel pipe was cold rolled into a square column (250 mm square to 550 mm square). A JIS 5 tensile test specimen was sampled from a flat portion of the resulting square column so that the tensile direction was the pipe longitudinal direction in accordance with the provisions of JIS Z 2210. A tensile test was performed in accordance with provisions of JIS Z 2241 to determine the yield ratio. A V-notch test specimen was sampled from a ¼ t thickness position of a flat portion of the resulting square column so that the pipe longitudinal direction was the test specimen longitudinal direction and a Charpy impact test was performed in accordance with provisions of JIS Z 2242 at a test temperature of 0° C. to determine the absorbed energy (J).

A microstructure observation specimen was sampled from the hot rolled steel strip used as the raw material of the square column. The observation face of the specimen was at the ¼ t thickness position of a cross section (L cross section) taken in the rolling direction. The specimen was polished and etched with nital, and the microstructure thereof was observed with an optical microscope or a scanning microscope. The microstructure image obtained was analyzed with an image analyzer to determine the volume fraction of each phase, the mean crystal grain diameter of each phase by an intercept method, and the mean crystal grain diameter of the primary phase and the second phase together.

As shown in FIG. 1, six line segments each 125 μm in length were drawn in the rolling direction and another six in the sheet thickness direction in the microstructure image obtained and the number of crystal grains of each phase that intersect these line segments was counted. The second phase frequency defined by the following equation was calculated from the obtained number of grains of each phase intersecting the line segments: Second phase frequency=(Number of second phase grains intersecting the line segments)/(Total number of grains of primary phase and second phase intersecting the line segments). The second phase was constituted by pearlite and bainite and the primary phase was constituted by polygonal ferrite.

Figure 2A:
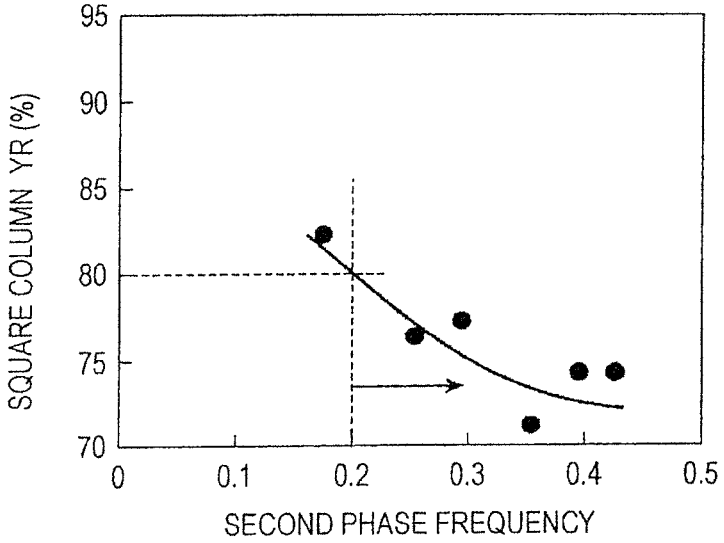
FIGS. 2A-2B include graphs indicating the influence of the second phase frequency on a yield ratio YR and a Charpy absorbed energy $vE_0$ at a test temperature of 0° C. of a cold-formed square column.
Figure 2B:
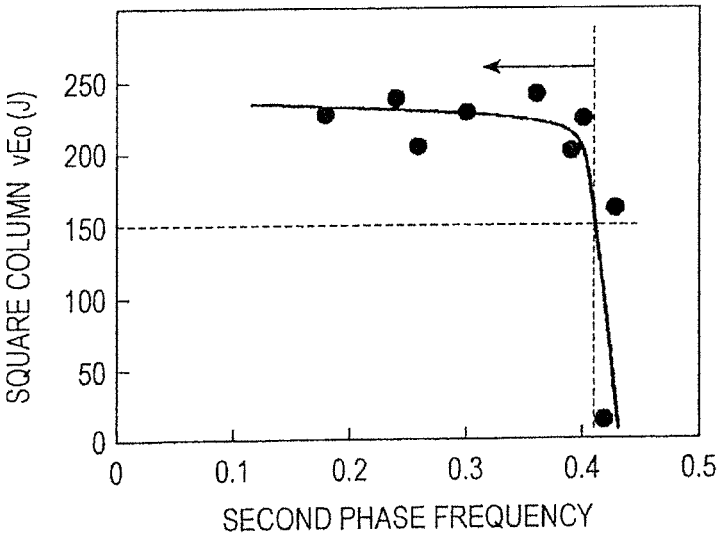
Figure 3A:
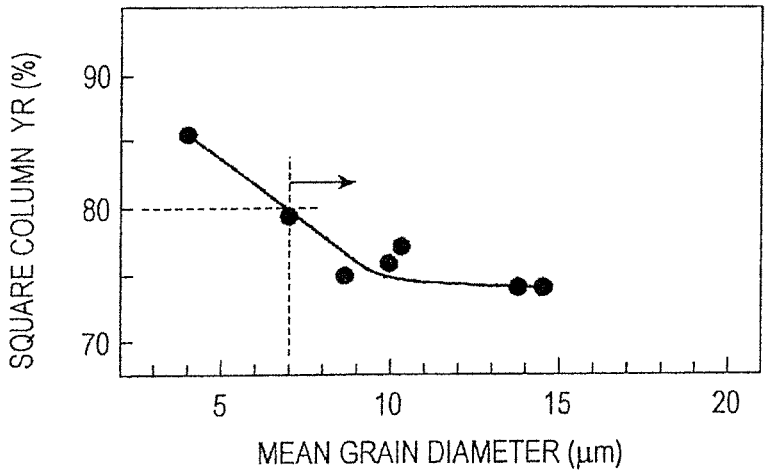
FIGS. 3A-3B include graphs indicating the influence of a mean crystal grain diameter on a yield ratio YR and a Charpy absorbed energy $vE_0$ at a test temperature of 0° C. of a cold-formed square column.
Figure 3B:
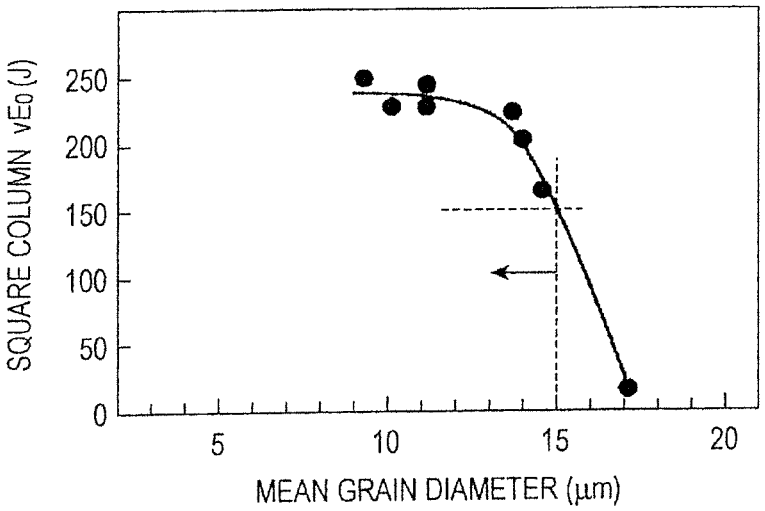

FIG. 2A is a graph showing the relationship between the second phase frequency of a hot rolled steel strip used as the raw material and the yield ratio YR of a flat portion of a cold-formed square column and FIG. 2B is a graph showing the relationship between the second phase frequency and the absorbed energy $vE_0$ of the flat portion measured in a Charpy impact test at a test temperature of 0° C. FIG. 3A is a graph showing the relationship between the mean crystal grain diameter of the primary phase and the second phase together of the hot rolled steel strip used as the raw material and the yield ratio YR of the flat portion of the cold-formed square column and FIG. 3B is a graph showing the relationship between the mean crystal grain diameter and the absorbed energy $vE_0$ of the flat portion measured in a Charpy impact test at a test temperature of 0° C.

FIGS. 2A and 2B show that the yield ratio YR and the absorbed energy $vE_0$ in a Charpy impact test of a flat portion of a cold-formed square column can be characterized with less variation by using the second phase frequency. This shows that the second phase frequency significantly affects the toughness and yield ratio of the cold-formed square column. FIGS. 3A and 3B show that the yield ratio YR and the absorbed energy $vE_0$ in a Charpy impact test of a flat portion of a cold-formed square column can also be characterized with less variation by using the mean crystal grain diameter of the primary phase (ferrite) and the second phase (pearlite and bainite) together. This shows that the mean crystal grain diameter significantly affects the toughness and yield ratio of the cold-formed square column. When the microstructure of a region from a surface to near a ¼ t position has come to have a microstructure including bainite as the primary phase as a result of quenching, the yield ratio increases notably.

FIGS. 2A, 2B, 3A and 3B also show that a yield ratio YR of 80% or less in a cold-formed square column, can be achieved by adjusting the second phase frequency to 0.20 or more and the mean crystal grain diameter of the primary phase (ferrite) and the second phase (pearlite and bainite) together to 7 μm or more. It is also shown that an absorbed energy $vE_0$ of 150 J or more in a Charpy impact test of a cold-formed square column can be achieved by adjusting the second phase frequency to 0.42 or less and the mean crystal grain diameter of the primary phase (ferrite) and the second phase (pearlite and bainite) together to 15 μm or less.

Figure 4:
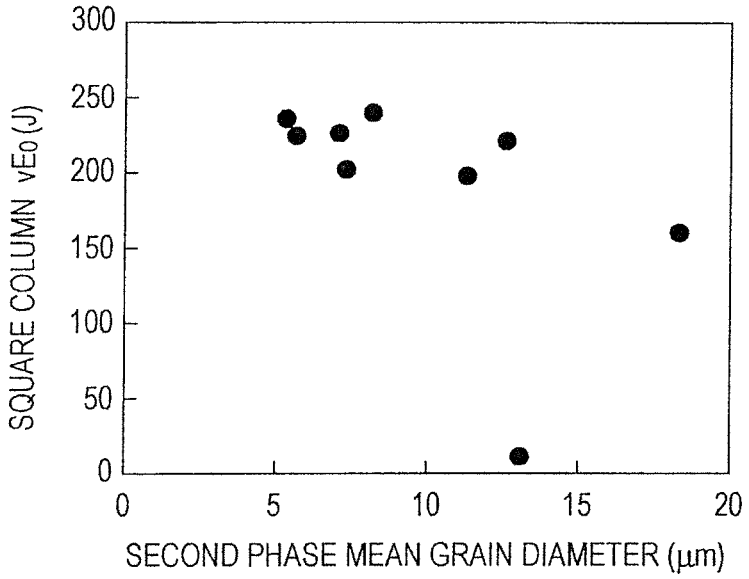
FIG. 4 is a graph indicating the relationship between a Charpy absorbed energy $vE_0$ at a test temperature of 0° C. of a cold-formed square column and a mean grain diameter of a second phase.
Figure 5:
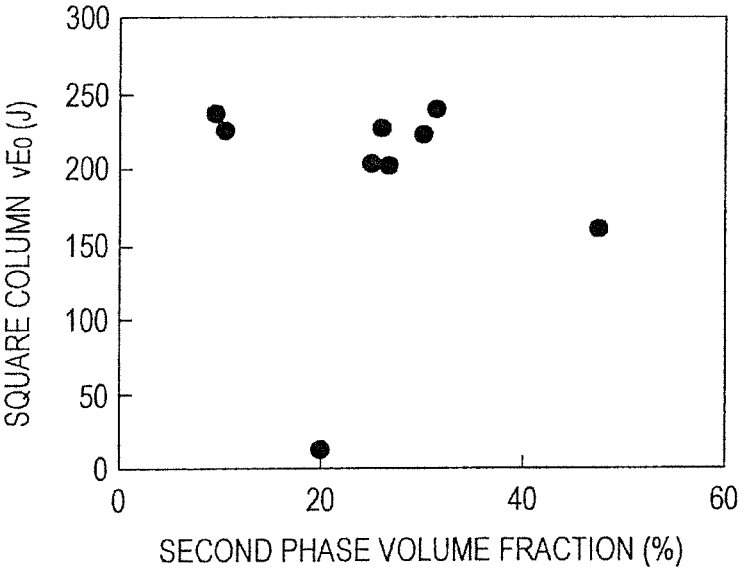
FIG. 5 is a graph indicating the relationship between a Charpy absorbed energy $vE_0$ at a test temperature of 0° C. of a cold-formed square column and a second phase microstructure volume fraction.

For reference, the relationship between the Charpy absorbed energy $vE_0$ of a flat portion of a cold-formed square column and a second phase mean grain diameter of a hot rolled steel strip used as a raw material is shown in FIG. 4 and the relationship between $vE_0$ and the second phase microstructure volume fraction is shown in FIG. 5. FIGS. 4 and 5 show the relationship between $vE_0$ and the second phase mean grain diameter and the relationship between $vE_0$ and the second phase microstructure volume fraction have large variations and that the toughness of the flat portion of the cold-formed square column cannot be satisfactorily evaluated based on either the second phase mean grain diameter or the second phase microstructure volume fraction.

Our hot rolled steel sheets have a strength of 215 MPa or more in terms of yield strength and 400 to 510 MPa in terms of tensile strength, a low yield ratio of 75% or less, preferably an elongation of 28% or more, and high toughness of 180 J or more in terms of absorbed energy in a Charpy impact test at a test temperature of 0° C. and preferably at −30° C.

First, the reasons for setting limitations on the composition of the hot rolled steel sheet are described. In the description below, % by mass is merely indicated by % unless otherwise noted.

C: 0.07 to 0.18%

Carbon (C) is an element that increases the strength of a steel sheet by solution strengthening and contributes to formation of pearlite, which is a part of the second phase. To obtain desired tensile properties, toughness, and steel sheet microstructure, the C content needs to be 0.07% or more. At a C content exceeding 0.18%, the desired steel sheet microstructure is no longer obtained and the desired tensile properties and toughness of the hot rolled steel sheet and the square column cannot be obtained. Accordingly, the C content is 0.07 to 0.18%. Preferably, the C content is 0.09 to 0.17%.

Mn: 0.3 to 1.5%

Manganese (Mn) is an element that increases the strength of a steel sheet through solution strengthening and the content thereof needs to be 0.3% or more to obtain the desired steel sheet strength. At a Mn content less than 0.3%, the ferrite transformation start temperature rises and the microstructure tends to coarsen. At a Mn content exceeding 1.5%, the yield strength of the steel sheet increases excessively. Thus, the yield ratio of a square column manufactured by cold-forming such a steel sheet exhibits a high yield ratio and the desired yield ratio can no longer be obtained. Accordingly, the Mn content is limited to 0.3 to 1.5%. The Mn content is preferably 0.35 to 1.4%.

P: 0.03% or Less

Phosphorus (P) is an element that segregates at ferrite grain boundaries and has an effect of decreasing toughness. P is an impurity and the content thereof is preferably as low as possible. However, since excessively decreasing the P content increases the refining cost, the P content is preferably 0.002% or more. A P content up to 0.03% is allowable. Thus, the P content is limited to 0.03% or less and more preferably 0.025% or less.

S: 0.015% or Less

Sulfur (S) exists as sulfides in steel and, in our composition range, mainly exists as MnS. MnS becomes thinly stretched in a hot rolling step and adversely affects ductility and toughness. Accordingly, the S content is preferably as low as possible. However, excessively decreasing the S content increases the refining cost and thus the S content is preferably 0.0002% or more. The S content up to 0.015% is allowable. Thus, the S content is limited to 0.015% or less and preferably 0.010% or less.

Al: 0.01 to 0.06%

Aluminum (Al) is an element that acts as a deoxidizer and has an effect of fixing N as AlN. The Al content needs to be 0.01% or more to achieve these effects. At an Al content less than 0.01%, deoxidizing power is insufficient if Si is not added, the amount of oxide-based inclusions is increased, the cleanliness of the steel sheet is degraded, and the quality of a welded portion of the square column is adversely affected. At an Al content exceeding 0.06%, an amount of Al dissolved as a solid solution is increased, the risk of formation of oxides in the welded portion is increased during welding of a square column, in particular, welding in air, and the toughness of the welded portion of the square column is decreased. Accordingly, the Al content is limited to 0.01 to 0.06%. Preferably, the Al content is 0.02 to 0.05%.

N: 0.006% or Less

Nitrogen (N) decreases ductility of a steel sheet and weldability of a square column and thus the N content is desirably as low as possible. A N content up to 0.006% is allowable. Accordingly, the N content is limited to 0.006% or less and is preferably 0.005% or less.

The elements described heretofore are the basic components. In addition to these basic components, Si: less than 0.4%, and/or at least one selected from Nb: 0.015% or less, Ti: 0.030% or less, and V: 0.070% or less, and/or B: 0.008% or less can be selected as needed as optional elements.

Si: Less than 0.4%

Silicon (Si) is an element that contributes to increasing the strength of a steel sheet by solution strengthening and can be added as needed to obtain the desired steel sheet strength. To achieve this effect, the Si content preferably exceeds 0.01% but at a Si content of 0.4% or more, fayalite also known as red scale easily forms on surfaces of a steel sheet and appearance properties of surfaces are frequently degraded. Accordingly, the Si content is preferably less than 0.4% if Si is to be added. When Si is not intentionally added, the content of Si as an unavoidable impurity is 0.01% or less.

At least one selected from Nb: 0.015% or less, Ti: 0.030% or less, and V: 0.070% or less.

Niobium (Nb), titanium (Ti), and vanadium (V) all form carbides and nitrides and are elements that have an effect of reducing the crystal grain diameter and the yield ratio tends to be high as a result. Accordingly, these elements are desirably not contained but as long as their contents are within the range that does not excessively decrease the crystal grain diameter, in other words, within the range in which the mean grain diameter of the ferrite phase and the second phase (pearlite and bainite) together is 7 μm or more, these elements may be contained. The content ranges are Nb: 0.015% or less, Ti: 0.030% or less, and V: 0.070% or less.

B: 0.008% or Less

Boron (B) is an element which delays ferrite transformation during a cooling process, promotes formation of a low-temperature transformed ferrite, i.e., an acicular ferrite phase, and increases the strength of a steel sheet. Addition of B increases the yield ratio of a steel sheet and thus increases the yield ratio of a square column. Accordingly, boron can be contained as needed as long as the yield ratio of the square column is 80% or less. Such a B content is 0.008% or less.

The balance other than the components described above is Fe and unavoidable impurities. As unavoidable impurities, O: 0.005% or less and N: 0.005% or less are allowable.

Next, the reasons for setting limitations on the microstructure of a hot rolled steel sheet are described.

Our hot rolled steel sheets have the above-described composition and a microstructure that includes ferrite as a primary phase and a second phase. The second phase is constituted by pearlite or pearlite and bainite. The primary phase referred here is a phase having an area fraction of 50% or higher.

The second phase constituted by pearlite or pearlite and bainite has a second phase frequency of 0.20 to 0.42. At a second phase frequency less than 0.20, the yield ratio of a square column obtained by cold forming exceeds 0.80 and fails to satisfy the yield ratio required (0.80 or less) as building structural members. At a second phase frequency exceeding 0.42, the desired toughness required for a square column for building structural members, namely, an absorbed energy $vE_0$ of 150 J or more in a Charpy impact test at a test temperature of 0° C. cannot be obtained. Accordingly, the second phase frequency is 0.20 to 0.42. Preferably, the second phase frequency is 0.40 or less. To obtain high toughness, namely, an absorbed energy $vE_{-30}$ of 150 J or more in a Charpy impact test at a test temperature of −30° C., the second phase frequency is preferably 0.35 or less. The second phase frequency is defined by the following equation:

Second phase frequency=(Number of second phase grains intersecting line segments of particular length)/(Total number of primary phase grains and second phase grains intersecting line segments of particularly length)

The measurement method is as described above.

The hot rolled steel sheet has a microstructure that has not only the above-described second phase frequency but also a mean crystal grain diameter of 7 to 15 μm for the ferrite phase, which is a primary phase, and a second phase together.

"The mean crystal grain diameter of the ferrite phase, which is a primary phase, and a second phase together" refers to the mean crystal grain diameter determined by measuring all crystal grains in the ferrite phase, which is the primary phase, and the pearlite phase and the bainite phase which form the second phase. The mean crystal grain diameter is measured by using a microstructure observation test specimen sampled from a particular position of a hot rolled steel sheet. A cross section of the test specimen taken in the rolling direction (L cross section) is polished, etched with nital, subjected to microstructural observation with an optical microscope (magnitude: 500) or a scanning electron microscope (magnitude: 500) at a ¼ t sheet thickness position, and photographed for one or more areas of view, and the obtained photograph or image was subjected to image processing so that the mean grain diameter is calculated by an intercept method.

When the mean crystal grain diameter measured by the method described above is less than 7 μm, the grains are too fine for a square column to achieve a yield ratio of 80% or less. If the grains are coarsened to 15 μm or larger, the toughness of the square column is degraded and a desired toughness cannot be obtained. From the viewpoint of reliably achieving higher toughness, the mean grain diameter is preferably 12 μm or less. A hot rolled steel sheet having the above-described composition and the above-described microstructure has a strength of 215 MPa or more in terms of yield strength and 400 to 510 MPa in terms of tensile strength, a low yield ratio of 75% or less, and a high toughness of 180 J or more in terms of an absorbed energy in a Charpy impact test at a test temperature of 0° C. and preferably at a test temperature of −30° C. When such a hot rolled steel sheet is used as a raw material and cold-rolled into a square column, a square column having a strength of 295 MPa or more in terms of yield strength and 400 to 550 MPa in terms of tensile strength and a low yield ratio of 80% or less in the column axis direction, and high toughness of 150 J or more in terms of an absorbed energy in a Charpy impact test at a test temperature of 0° C. and preferably at a test temperature of −30° C. can be obtained.

Next, a preferred method of manufacturing a hot rolled steel sheet is described. A hot rolled steel sheet is manufactured by subjecting a steel having the above-described composition to a hot rolling step, a cooling step, and a coiling step.

The steel to be used is manufactured such that a molten steel having the above-described composition is produced by a common known refining method such as one using a converter, electric furnace, vacuum melting furnace or the like, and then cast into a slab with desired dimensions by a common known casting method such as a continuous casting method. The molten steel may be further subjected to secondary refining such as ladle refining. Instead of the continuous casting method, an ingot-slabbing method may be employed.

In a hot rolling step, a steel having the above-described composition is heated to a heating temperature of 1100 to 1300° C. and subjected to rough rolling at a rough rolling end temperature of 950 to 1150° C. to form a sheet bar. The sheet bar is then finish-rolled at a finish rolling start temperature of 1100 to 850° C. and a finish rolling end temperature of 750 to 900° C. Heating temperature: 1100 to 1300° C.

When the heating temperature for the steel is less than 1100° C., deformation resistance of a material to be rolled becomes excessively large and withstand load and rolling torque of a roughing mill and a finishing mill become insufficient, thereby the rolling becomes difficult to be performed. In contrast, when the heating temperature exceeds 1300° C., austenite crystal grains coarsen and it becomes difficult to refine the crystal grains even if deforming and recrystallizing of austenite grains are repeated by performing rough rolling and finish rolling. Thus, it becomes difficult for the hot rolled steel sheet to obtain the desired mean crystal grain diameter. Accordingly, the heating temperature of the steel is preferably limited to 1100 to 1300° C. More preferably, the heating temperature is 1100 to 1250° C. If the withstand load and rolling torque of the rolling mill allow, a heating temperature in the range of 1100° C. or less and the Ac3 transformation point or more can be selected. The thickness of the steel may be about 200 to 350 mm, which is the thickness generally employed, and is not particularly limited.

The heated steel is subjected to rough rolling to be formed into a sheet bar. Rough rolling end temperature: 950 to 1150° C.

When the heated steel is subjected to rough rolling, austenite grains are deformed and recrystallized become finer. At a rough rolling end temperature less than 950° C., the withstand load and rolling torque of the roughing mill tend to be insufficient. In contrast, in the case where the temperature exceeds 1150° C., austenite grains coarsen and it becomes difficult to obtain the desired mean crystal grain diameter of 15 μm or less even if finish rolling is performed subsequently. Accordingly, the rough rolling end temperature is preferably limited to 950 to 1150° C. This rough rolling end temperature range can be achieved by adjusting the heating temperature of the steel, retention between passes of rough rolling, thickness of the steel and the like. If the withstand load and the rolling torque of the rolling mill allow, the lower limit of the rough rolling end temperature may be at least 100° C. higher than the Ar3 transformation point. The thickness of the sheet bar may be any value as long as the product sheet (hot rolled steel sheet) has a desired thickness after finish rolling, and thus is not particularly limited. An appropriate sheet bar thickness is about 32 to 60 mm.

The sheet bar is then subjected to finish rolling in a tandem rolling mill to be formed into a hot rolled steel sheet.

Finish Rolling Start Temperature (Finishing Entry Temperature): 1100 to 850° C.

In finish rolling, rolling and recrystallization are repeated and refining of the austenite (γ) grains proceeds. When the finish rolling start temperature (finishing entry temperature) is decreased, working strain introduced by rolling tends to remain and grain refining of γ grains is easily achieved. When the finish rolling start temperature (finishing entry temperature) is less than 850° C., the temperature near the steel sheet surfaces in the finishing mill decreases to the Ar3 transformation temperature or less and a risk of ferrite generation increases. The generated ferrite forms ferrite grains stretched in the rolling direction as a result of the subsequent finish rolling and causes degradation of workability. In contrast, when the finish rolling start temperature (finishing entry temperature) exceeds 1100° C., the above-described γ grain refining effect brought about by finish rolling is decreased and it becomes difficult to obtain a hot rolled steel sheet having a desired mean crystal grain diameter of 15 μm or less. Accordingly, the finishing entry temperature (finish rolling start temperature) is preferably limited to 1100 to 850° C. and more preferably 1050 to 850° C.

Finish Rolling End Temperature (Finishing Delivery Temperature): 900 to 750° C.

If the finish rolling end temperature (finishing delivery temperature) exceeds 900° C., the work strain applied during finish rolling becomes insufficient, refining of the γ grains is not achieved, and thus, it becomes difficult for the hot rolled steel sheet to achieve a desired mean crystal grain diameter of 15 μm or less. In contrast, if the finish rolling end temperature (finishing delivery temperature) is less than 750° C., the temperature near the surfaces of the steel sheet in the finishing mill is equal to the Ar3 transformation point or less, ferrite grains stretched in the rolling direction are formed, ferrite grains form mixed grains, and the risk of degradation of workability is increased. Accordingly, the finishing delivery temperature (finish rolling end temperature) is preferably limited to 900 to 750° C. and more preferably 850 to 750° C.

More preferably, in the finish rolling discussed above, the total reduction of the finish rolling is 35 to 70%. If the total reduction is less than 35%, it is difficult to apply work strain sufficient for refining γ grains and it becomes difficult to obtain a hot rolled steel sheet having a desired mean crystal grain diameter. At a total reduction exceeding 70%, the with-stand load and rolling torque of the rolling mill may become insufficient in some cases and γ grains stretched and elongated in the rolling direction are formed, thereby forming elongated ferrite grains, and the risk of degradation of workability is increased. Accordingly, the total reduction of the finish rolling is preferably 35 to 70% and more preferably 40 to 70%.

Upon completion of finish rolling, a cooling step is performed. As the cooling step, two cooling methods are proposed: Cooling method (1) and cooling method (2).

Cooling Method (1)

In the cooling step, cooling of the hot rolled steel sheet is started immediately after completion of the finish rolling and the cooling is performed down to a coiling temperature such that the average cooling rate in the temperature range of 750 to 650° C. in terms of surface temperature is 20° C./s or less, the time taken for the temperature at the sheet thickness center to reach 650° C. is within 30 s, and the average cooling rate in the temperature range of 750 to 650° C. at the sheet thickness center is 4 to 15° C./s. The cooling end temperature is preferably in the range of the coiling temperature to 50° C. higher than the coiling temperature.

"Immediately after completion of the finish rolling" means within 10 s from the completion of the finish rolling. If cooling does not start within 10 s after the completion of the rolling, in other words, if the time the steel is retained at high temperature is long, grain growth proceeds and γ grains coarsen. Accordingly, cooling starts within 10 s and more preferably within 8 s after completion of the finish rolling.

Average Cooling Rate at Steel Sheet Surface: 20° C./s or Less

When the average cooling rate at the steel sheet surfaces exceeds 20° C./s, the regions near the steel sheet surfaces undergo a bainite generation region during cooling, resulting in formation of a bainite phase. Accordingly, the desired microstructure constituted of ferrite and the second phase cannot be formed, the desired second phase frequency cannot be obtained, the yield ratio is increased, and the desired low yield ratio in the column axis direction cannot be achieved when the steel sheet is cold-formed into a square column. Thus, the average cooling rate at steel sheet surfaces is preferably limited to 20° C./s or less and more preferably 4 to 18° C./s. The average cooling rate of the steel sheet surfaces discussed here is the average of 750 to 650° C.

Time Taken for the Temperature at the Sheet Thickness Center to Reach 650° C.: Within 35 s If a cooling time for the temperature at the sheet thickness center to reach 650° C. is more than 35 s from the start of cooling, high temperature is retained before generation of a pearlite phase and thus crystal grains coarsen. As a result, the second phase frequency exceeds 0.42 and the desired hot rolled steel sheet toughness cannot be obtained. To further improve the toughness, it is preferable to control the time taken for the temperature at the sheet thickness center to reach 650° C. to 30 s or less. When the time is 30 s or less, the cold-formed square column can obtain a toughness of 150 J or more in terms of Charpy absorbed energy $vE_{30}$ at a test temperature of −30° C.

Average Cooling Rate at Sheet Thickness Center: 4 to 15° C./s

If the average cooling rate at the sheet thickness center is less than 4° C./s, the frequency of ferrite grain generation is reduced, the ferrite crystal grains coarsen, and a hot rolled steel sheet having a desired mean crystal grain diameter of 15 μm or less cannot be obtained. In contrast, if the rate exceeds 15° C./s, formation of pearlite is suppressed and coarse bainite grains are generated. Hence, a hot rolled steel sheet having the desired mean crystal grain diameter cannot be obtained. Thus, it is preferable to limit the average cooling rate at the sheet thickness center to 4 to 15° C./s and more preferably 4.5 to 14° C./s. The average cooling rate at the steel sheet thickness center discussed here refers to the average of 750 to 650° C.

The cooling rate at the sheet thickness center is a value determined by heat-transfer calculation. After cooling, a coiling step is performed. In the coiling step, coiling is performed at a coiling temperature of 500 to 650° C. and the coiled sheet is then allowed to cool.

Coiling Temperature: 500 to 650° C.

At a coiling temperature less than 500° C., generation of pearlite is suppressed, the fraction of aggregated bainite grains with a large lath spacing mixing in is increased, the desired microstructure cannot be obtained, and the cold-formed square column cannot achieve the desired yield ratio and toughness. At a coiling temperature exceeding 650° C., pearlite transformation proceeds after coiling, resulting in such a problem as disturbance of the coil shape and the desired toughness cannot be obtained due to an excessively large mean grain diameter. Accordingly, the coiling temperature is preferably limited to 500 to 650° C. and more preferably 520 to 630° C.

Cooling Method (2)

The cooling step is a step including sequentially performing, immediately after completion of finish rolling, first cooling, second cooling, and third cooling.

Upon start of the cooling of the hot rolled steel sheet, first cooling is performed first. The temperature used in the cooling step is a value (temperature) obtained by heat-transfer calculation.

In the first cooling, cooling is performed so that the cooling end temperature is 550° C. or more in terms of surface temperature.

If the cooling end temperature of the first cooling is less than 550° C., the regions near the steel sheet surfaces, in particular, undergo a bainite generation region and a bainite phase is formed. Thus, the desired microstructure constituted of ferrite and the second phase cannot be formed. Thus, the desired second phase frequency cannot be obtained, the yield ratio is increased, and the desired low yield ratio in the column axis direction cannot be achieved when the sheet is formed into a cold-formed square column. Due to these reasons, the cooling end temperature of the first cooling is limited to 550° C. or more. As long as the cooling end temperature is 550° C. or more, the cooling rate during the cooling is not particularly limited. As a result, formation of bainite in the surface layers can be stably avoided and the desired hot rolled microstructure can be stably formed.

After completion of the first cooling, second cooling is performed.

Second cooling is air cooling for 3 to 15 s after completion of the first cooling. In the second cooling, the sheet is retained in the high-temperature ferrite generation region to suppress generation of bainite. If the air cooling time is less than 3 s, the risk that the sheet would undergo the bainite generation region in the subsequent cooling (third cooling) becomes higher. If the air cooling time is longer than 15 s, the ferrite grains coarsen. Accordingly, the air cooing time in the second cooling is limited to 3 to 15 s. Preferably, the air cooling time is 4 to 13 s.

After completion of the second cooling, third cooling is performed.

In the third cooling, cooling is performed to a temperature of 650° C. or less at an average cooling rate of 4 to 15° C./s at 750 to 650° C. in terms of a sheet thickness center temperature.

If the average cooling rate at the steel sheet thickness center is less than 4° C./s, the frequency of ferrite grain generation is decreased, ferrite crystal grains coarsen, and a hot rolled steel sheet having a desired mean crystal grain diameter of 15 μm or less cannot be obtained. In contrast, at a rate exceeding 15° C./s, generation of pearlite is suppressed and coarse bainite grains are generated. Thus, a hot rolled steel sheet having a desired mean crystal grain diameter cannot be obtained. Accordingly, the average cooling rate at the sheet thickness center is preferably limited to 4 to 15° C./s and more preferably 4.5 to 14° C./s. The average cooling rate at the steel sheet thickness center discussed here refers to the average of 750 to 650° C.

In the cooling step, the above-described first cooling, second cooling, and third cooling are sequentially performed such that the time taken for the temperature at the sheet thickness center to reach 650° C. from the start of cooling is within 35 s. If the cooling time takes longer than 35 s for the temperature at the sheet thickness center to reach 650° C. from the start of cooling, high temperature is retained before generation of a pearlite phase, crystal grains coarsen, the second phase frequency exceeds 0.42, and thus the desired hot rolled steel sheet toughness cannot be obtained. To further improve the toughness, the time taken for the temperature at the sheet thickness center to reach 650° C. is preferably 30 s or less. When the time is 30 s or less, the toughness of the cold-formed square steel sheet can be adjusted to 150 J or more in terms of Charpy absorbed energy $vE_{-30}$ at a test temperature of −30° C.

After completion of the third cooling, fourth cooling is preferably performed if needed. Fourth cooling is performed to coil the steel sheet accurately at a desired coiling temperature. After completion of the third cooling, it is preferable to measure the temperature of the steel sheet and appropriately adjust the water-cooling time so that the desired coiling temperature can be achieved. If the desired coiling temperature is not obtained by fourth cooling, fifth cooling (water cooling) may be performed.

After completion of cooling, a coiling step is performed.

In the coiling step, coiling is performed at a coiling temperature of 500 to 650° C., followed by cooling in the air.

Coiling Temperature: 500 to 650° C.

At a coiling temperature less than 500° C., generation of pearlite is suppressed, the fraction of aggregated bainite grains with large lath spacing mixing in is high, the desired microstructure cannot be obtained, and a cold-formed square column cannot achieve the desired yield ratio and toughness. If the coiling temperature exceeds 650° C., pearlite transformation proceeds after coiling and thus such a problem as coil shape is disrupted. Thus, the coiling temperature is preferably limited to 500 to 650° C. and more preferably 520 to 630° C.

Our methods will be further described in detail by using Examples below.

EXAMPLES

Each of molten steels having compositions indicated in Table 1 was produced with a converter and cast into a slab by a continuous casting method (steel: 215 mm in thickness). The slab (steel) was heated to the heating temperature indicated in Tables 2 and 3, and subjected to a hot rolling step, a cooling step, and a coiling step indicated in Tables 2 and 3. As a result, a hot rolled steel sheet having a thickness of 12 to 25 mm was obtained. The hot rolled steel sheet was used as a raw material and subjected to cold roll forming to form a round steel pipe. The round steel pipe was subjected to cold roll forming to form a square column (250 to 550 mm square).

A test specimen was taken from the hot rolled steel sheet and subjected to microstructure observation, tensile test, and impact test. The test procedures were as follows.

(1) Microstructural Observation

A microstructure observation specimen was taken from the hot rolled steel sheet so that the observation surface was the L cross section. The specimen was polished and etched with nital. The microstructure at a ¼ t sheet thickness position was observed with an optical microscope (magnitude: 500) or a scanning electron microscope (magnitude: 500) and was photographed. The obtained microstructure image was analyzed with an image analyzer to determine the types of the primary phase and the second phase and the mean crystal grain diameter of the primary phase and the second phase together was calculated by an intercept method.

As shown in FIG. 1, six line segments each 125 μm in length were drawn on the obtained microstructure image in the rolling direction and another six in the sheet thickness direction. The number of crystal grains of each phase intersecting these line segments was counted. Then the second phase frequency defined by the following equation was calculated based on the numbers of crystal grains of the respective phases intersecting the line segments:

Second phase frequency=(Number of second phase grains intersecting line segments)/(Total number of primary phase grains and second phase grains intersecting line segments).

(2) Tensile Test

A JIS 5 tensile test specimen was taken from the resulting hot rolled steel sheet so that the tensile direction was the rolling direction. A tensile test was performed in accordance with the provisions of JIS Z 2241 and the yield strength and the tensile strength were measured. The yield ratio (%) defined by (yield strength)/(tensile strength) was calculated.

(3) Impact Test

V-notched specimens were taken from the ¼ t sheet thickness position of the hot rolled steel sheet so that the longitudinal direction of the specimen was the rolling direction and subjected to a Charpy impact test in accordance with the provisions of JIS Z 2242 at a test temperature of 0° C. and −30° C. to determine the absorbed energy (J). The number of specimens for each test was 3.

A specimen was taken from a flat portion of the resulting square column and subjected to a tensile test and an impact test to evaluate the yield ratio and toughness.

(4) Square Column Tensile Test

A JIS 5 tensile test specimen was taken from a flat portion of the square column so that the tensile direction was the column longitudinal direction and subjected to a tensile test in accordance with the provisions of JIS Z 2241 to measure the yield strength and tensile strength. Then the yield ratio (%) defined by (yield strength)/(tensile strength) was calculated.

(5) Square Column Impact Test

V-notched specimens were taken from a ¼ t thickness position of a flat portion of the square column so that the longitudinal direction of the specimen was the longitudinal direction of the column and subjected to a Charpy impact test in accordance with the provisions of JIS Z 2242 at a test temperature of 0° C. and −30° C. to determine the absorbed energy (J). The number of specimens for each test was 3.

The results are indicated in Tables 4 and 5.

In each of our examples, a square column manufactured through cold forming satisfied the desired tensile properties, namely, a yield strength of 295 MPa or more, a tensile strength of 400 MPa or more, and a yield ratio of 80% or less, at a flat portion of the square column. Moreover, the absorbed energy vE0 (J) in a Charpy impact test at a test temperature of 0° C. was 150 J or more and the absorbed energy vE−30 (J) in a Charpy impact test at a test temperature of −30° C. was 150 J or more, showing high toughness. Thus, a hot rolled steel sheet having both the high toughness and the desired tensile properties was obtained. In contrast, all Comparative Examples outside our range fail to satisfy the desired low yield ratio, the desired high toughness, or both the desired low yield ratio and high toughness in the square column.

TABLE 1

| Steel | Chemical composition (mass %) | | | | | | | | | |
|---|---|---|---|---|---|---|---|---|---|---|
| No. | C | Si | Mn | P | S | Al | N | Nb, Ti, V | B | Note |
| A | 0.16 | 0.01 | 0.76 | 0.017 | 0.0025 | 0.030 | 0.0040 | — | — | Example |
| B | 0.09 | 0.02 | 1.35 | 0.018 | 0.0033 | 0.031 | 0.0035 | — | — | Example |
| C | 0.15 | 0.18 | 0.43 | 0.018 | 0.0030 | 0.040 | 0.0041 | — | — | Example |
| D | 0.12 | 0.01 | 1.03 | 0.015 | 0.0028 | 0.029 | 0.0040 | — | — | Example |
| E | 0.06 | 0.15 | 1.45 | 0.019 | 0.0022 | 0.033 | 0.0035 | — | — | Comparative Example |
| F | 0.21 | 0.01 | 0.58 | 0.021 | 0.0029 | 0.035 | 0.0034 | — | — | Comparative Example |
| G | 0.16 | 0.01 | 0.21 | 0.017 | 0.0031 | 0.039 | 0.0042 | — | — | Comparative Example |
| H | 0.16 | 0.02 | 1.85 | 0.015 | 0.0026 | 0.031 | 0.0031 | — | — | Comparative Example |
| I | 0.11 | 0.01 | 0.85 | 0.015 | 0.0027 | 0.031 | 0.0029 | Nb: 0.008 | — | Example |
| J | 0.15 | 0.01 | 0.65 | 0.016 | 0.0035 | 0.026 | 0.0035 | Ti: 0.016 | — | Example |
| K | 0.16 | 0.01 | 0.50 | 0.017 | 0.0045 | 0.029 | 0.0033 | V: 0.031 | — | Example |
| L | 0.16 | 0.01 | 0.76 | 0.015 | 0.0031 | 0.043 | 0.0040 | — | B: 0.0004 | Example |
| M | 0.11 | 0.02 | 0.75 | 0.020 | 0.0027 | 0.033 | 0.0042 | Nb: 0.029 | — | Comparative Example |
| N | 0.16 | 0.02 | 0.50 | 0.019 | 0.0039 | 0.029 | 0.0028 | Ti: 0.045 | — | Comparative Example |
| R | 0.11 | 0.18 | 0.35 | 0.014 | 0.0036 | 0.039 | 0.0037 | Nb: 0.010 | — | Example |
| S | 0.13 | 0.25 | 0.30 | 0.017 | 0.0033 | 0.045 | 0.0043 | Ti: 0.015 | — | Example |
| T | 0.12 | 0.19 | 0.39 | 0.016 | 0.0044 | 0.031 | 0.0027 | V: 0.042 | — | Example |
| U | 0.16 | 0.23 | 0.43 | 0.017 | 0.0034 | 0.042 | 0.0041 | — | B: 0.0006 | Example |
| V | 0.16 | 0.01 | 0.70 | 0.016 | 0.0025 | 0.032 | 0.0040 | Ti: 0.019 | B: 0.0005 | Example |

TABLE 2

| | | Hot rolling step | | | | | | |
|---|---|---|---|---|---|---|---|---|
| | | | Rough rolling | | Finish rolling | | | |
| Steel sheet No. | Steel No. | Heating temperature (° C.) | End temperature (° C.) | Sheet bar thickness (mm) | Start temperature (° C.) | End temperature (° C.) | Total reduction (%) | Product sheet thickness (mm) |
| 1 | A | 1200 | 1025 | 42 | 950 | 780 | 62 | 16 |
| 2 | A | 1180 | 1010 | 54 | 940 | 780 | 65 | 19 |
| 3 | A | 1200 | 1015 | 58 | 960 | 780 | 57 | 25 |
| 4 | A | 1350 | 1190 | 42 | 1120 | 900 | 62 | 16 |
| 5 | A | 1250 | 1150 | 42 | 1100 | 950 | 62 | 16 |
| 6 | A | 1200 | 1025 | 25 | 950 | 780 | 36 | 16 |
| 7 | A | 1250 | 1150 | 42 | 1050 | 890 | 62 | 16 |
| 8 | A | 1200 | 1025 | 42 | 950 | 780 | 62 | 16 |
| 9 | A | 1200 | 1025 | 42 | 950 | 780 | 62 | 16 |
| 10 | A | 1200 | 1025 | 38 | 950 | 780 | 68 | 16 |
| 11 | A | 1200 | 1025 | 42 | 950 | 780 | 62 | 16 |
| 12 | A | 1200 | 1025 | 42 | 950 | 780 | 62 | 16 |
| 13 | B | 1250 | 1075 | 54 | 1050 | 790 | 65 | 19 |
| 14 | C | 1150 | 975 | 58 | 920 | 790 | 57 | 25 |
| 15 | D | 1120 | 975 | 58 | 930 | 800 | 57 | 25 |
| 16 | E | 1200 | 1025 | 42 | 950 | 780 | 62 | 16 |
| 17 | F | 1200 | 1025 | 42 | 950 | 780 | 62 | 16 |
| 18 | G | 1200 | 1025 | 42 | 950 | 780 | 62 | 16 |
| 19 | H | 1200 | 1025 | 42 | 950 | 780 | 71 | 12 |
| 20 | I | 1200 | 1025 | 58 | 960 | 780 | 57 | 25 |
| 21 | J | 1200 | 1025 | 58 | 960 | 780 | 57 | 25 |
| 22 | K | 1200 | 1025 | 58 | 960 | 780 | 57 | 25 |
| 23 | L | 1210 | 1030 | 58 | 960 | 780 | 57 | 25 |
| 24 | M | 1220 | 1030 | 58 | 960 | 780 | 57 | 25 |
| 25 | N | 1200 | 1025 | 58 | 960 | 780 | 57 | 25 |
| 26 | R | 1210 | 1025 | 54 | 960 | 780 | 65 | 19 |
| 27 | S | 1220 | 1030 | 54 | 970 | 790 | 65 | 19 |
| 28 | T | 1200 | 1025 | 54 | 990 | 800 | 65 | 19 |
| 29 | U | 1210 | 1025 | 54 | 950 | 790 | 65 | 19 |
| 30 | V | 1190 | 1015 | 54 | 960 | 810 | 65 | 19 |

| | Cooling step | | | | Coiling step | |
|---|---|---|---|---|---|---|
| | | Average cooling rate (° C./s)* | | Cooling time (s) | | |
| Steel sheet No. | Cooling start time (s) | Surface | Sheet thickness center | Start of cooling to 650° C.** | Coiling temperature (° C.) | Notes |
| 1 | 2 | 16 | 6.0 | 25 | 600 | Example |
| 2 | 3 | 12 | 5.2 | 29 | 600 | Example |
| 3 | 3 | 20 | 13.0 | 29 | 600 | Example |
| 4 | 3 | 13 | 4.8 | 28 | 600 | Comparative Example |
| 5 | 3 | 13 | 4.8 | 41 | 600 | Comparative Example |
| 6 | 2 | 13 | 4.8 | 28 | 600 | Example |
| 7 | 15 | 13 | 4.8 | 43 | 600 | Comparative Example |
| 8 | 2 | 40 | 17.0 | 25 | 600 | Comparative Example |
| 9 | 3 | 11 | 3.3 | 37 | 600 | Comparative Example |
| 10 | 2 | 13 | 3.4 | 28 | 600 | Comparative Example |
| 11 | 2 | 20 | 15.0 | 20 | 450 | Comparative Example |
| 12 | 2 | 14 | 5.5 | 1500 | 660 | Comparative Example |
| 13 | 3 | 12 | 4.2 | 30 | 550 | Example |
| 14 | 3 | 19 | 4.6 | 29 | 630 | Example |
| 15 | 3 | 14 | 4.0 | 30 | 580 | Example |
| 16 | 2 | 20 | 7.0 | 25 | 550 | Comparative Example |
| 17 | 2 | 16 | 6.0 | 25 | 600 | Comparative Example |
| 18 | 2 | 16 | 6.0 | 25 | 600 | Comparative Example |
| 19 | 2 | 20 | 8.0 | 20 | 500 | Comparative Example |
| 20 | 3 | 15 | 4.5 | 33 | 600 | Example |
| 21 | 3 | 15 | 4.5 | 33 | 600 | Example |
| 22 | 3 | 15 | 4.5 | 33 | 600 | Example |
| 23 | 3 | 15 | 4.5 | 33 | 600 | Example |
| 24 | 3 | 15 | 4.5 | 33 | 600 | Comparative Example |
| 25 | 3 | 15 | 4.5 | 33 | 600 | Comparative Example |

TABLE 2-continued

| | | | | | | |
|---|---|---|---|---|---|---|
| 26 | 3 | 14 | 5.0 | 30 | 580 | Example |
| 27 | 3 | 12 | 5.3 | 28 | 590 | Example |
| 28 | 3 | 13 | 5.1 | 29 | 600 | Example |
| 29 | 3 | 14 | 5.0 | 32 | 600 | Example |
| 30 | 3 | 15 | 5.5 | 31 | 570 | Example |

*Average in the temperature range of 750 to 650° C.

**Temperature at sheet thickness center

TABLE 3

| | | Hot rolling step | | | | | | | Cooling step | | |
|---|---|---|---|---|---|---|---|---|---|---|---|
| | | | Rough rolling | | Finish rolling | | | | | First cooing | |
| Steel sheet No. | Steel No. | Heating temperature (° C.) | End temperature (° C.) | Sheet bar thickness (mm) | Start temperature (° C.) | End temperature (° C.) | Total reduction (%) | Product sheet thickness (mm) | Cooling start time (s) | Average cooling rate* (° C./s) | Cooling end temperature** (° C.) |
| 31 | A | 1200 | 1025 | 42 | 950 | 780 | 62 | 16 | 2 | 19 | 620 |
| 32 | A | 1180 | 1010 | 54 | 940 | 780 | 65 | 19 | 3 | 15 | 650 |
| 33 | A | 1200 | 1015 | 58 | 960 | 780 | 57 | 25 | 3 | 19 | 560 |
| 34 | A | 1350 | 1190 | 42 | 1120 | 900 | 62 | 16 | 3 | 20 | 610 |
| 35 | A | 1250 | 1150 | 42 | 1100 | 950 | 62 | 16 | 3 | 15 | 560 |
| 36 | A | 1200 | 1025 | 25 | 950 | 780 | 36 | 16 | 2 | 17 | 620 |
| 37 | A | 1250 | 1150 | 42 | 1050 | 890 | 62 | 16 | 15 | 17 | 630 |
| 38 | A | 1200 | 1025 | 42 | 950 | 780 | 62 | 16 | 2 | 14 | 490 |
| 39 | A | 1200 | 1025 | 42 | 950 | 780 | 62 | 16 | 3 | 19 | 615 |
| 40 | A | 1200 | 1025 | 38 | 950 | 780 | 68 | 12 | 2 | 20 | 590 |
| 41 | A | 1200 | 1025 | 42 | 950 | 780 | 62 | 16 | 2 | 18 | 620 |
| 42 | A | 1200 | 1025 | 42 | 950 | 780 | 62 | 16 | 2 | 18 | 600 |
| 43 | B | 1250 | 1075 | 54 | 1050 | 790 | 65 | 19 | 3 | 12 | 570 |
| 44 | C | 1150 | 975 | 58 | 920 | 790 | 57 | 25 | 3 | 18 | 600 |
| 45 | D | 1120 | 975 | 58 | 930 | 800 | 57 | 25 | 3 | 19 | 620 |
| 46 | E | 1200 | 1025 | 42 | 950 | 780 | 62 | 16 | 2 | 14 | 560 |
| 47 | F | 1200 | 1025 | 42 | 950 | 780 | 62 | 16 | 2 | 13 | 600 |
| 48 | G | 1200 | 1025 | 42 | 950 | 780 | 62 | 16 | 2 | 20 | 620 |
| 49 | H | 1200 | 1025 | 42 | 950 | 780 | 71 | 12 | 2 | 12 | 660 |
| 50 | I | 1200 | 1025 | 58 | 1025 | 780 | 57 | 25 | 3 | 19 | 600 |
| 51 | J | 1200 | 1025 | 58 | 1025 | 780 | 57 | 25 | 3 | 20 | 570 |
| 52 | K | 1200 | 1025 | 58 | 1025 | 780 | 57 | 25 | 3 | 15 | 600 |
| 53 | L | 1210 | 1030 | 58 | 1030 | 780 | 57 | 25 | 3 | 17 | 620 |
| 54 | M | 1200 | 1030 | 58 | 1030 | 780 | 57 | 25 | 3 | 17 | 560 |
| 55 | N | 1200 | 1025 | 58 | 1025 | 780 | 57 | 25 | 3 | 15 | 590 |
| 56 | R | 1210 | 1025 | 54 | 960 | 780 | 65 | 19 | 3 | 16 | 640 |
| 57 | S | 1220 | 1030 | 54 | 970 | 790 | 65 | 19 | 3 | 16 | 610 |
| 58 | T | 1200 | 1025 | 54 | 990 | 800 | 65 | 19 | 3 | 17 | 570 |
| 59 | U | 1150 | 1000 | 54 | 950 | 790 | 65 | 19 | 3 | 15 | 600 |
| 60 | V | 1190 | 1015 | 54 | 960 | 810 | 65 | 19 | 3 | 17 | 620 |

| | Second cooling | Third cooling | Cooling time | Fourth cooling | | | Coiling | |
|---|---|---|---|---|---|---|---|---|
| Steel sheet No. | Air cooling time (s) | Average cooling rate*** (° C./s) | Start of cooling to 650° C.**** (s) | Whether fourth cooling is performed | Air cooling time (s) | Water cooling time (s) | step Coiling temperature (° C.) | Notes |
| 31 | 10 | 6.0 | 27 | Yes | 17 | 3 | 600 | Example |
| 32 | 9 | 5.2 | 28 | Yes | 15 | 3 | 600 | Example |
| 33 | 8 | 13.0 | 23 | No | — | — | 610 | Example |
| 34 | 9 | 4.8 | 59 | Yes | 16 | 2 | 600 | Comparative Example |
| 35 | 1 | 15.0 | 84 | No | — | — | 620 | Comparative Example |
| 36 | 10 | 5.5 | 29 | Yes | 17 | 2 | 600 | Example |
| 37 | 15 | 5.1 | 62 | No | — | — | 620 | Comparative Example |
| 38 | 10 | 14.0 | 35 | No | — | — | 590 | Comparative Example |
| 39 | 8 | 3.3 | 32 | Yes | 15 | 4 | 580 | Comparative Example |
| 40 | 8 | 22.0 | 20 | Yes | 13 | 6 | 590 | Comparative Example |
| 41 | 10 | 15.0 | 22 | No | — | — | 450 | Comparative Example |

TABLE 3-continued

| | | | | | | | | |
|---|---|---|---|---|---|---|---|---|
| 42 | 8 | 5.5 | 1600 | No | — | — | 670 | Comparative Example |
| 43 | 6 | 4.2 | 33 | Yes | 12 | 2 | 550 | Example |
| 44 | 8 | 4.6 | 30 | No | — | — | 630 | Example |
| 45 | 11 | 4.0 | 35 | Yes | 10 | 4 | 580 | Example |
| 46 | 7 | 7.0 | 30 | Yes | 17 | 3 | 550 | Comparative Example |
| 47 | 8 | 6.0 | 31 | No | — | — | 600 | Comparative Example |
| 48 | 7 | 6.0 | 23 | No | — | — | 600 | Comparative Example |
| 49 | 10 | 8.0 | 26 | Yes | 17 | 3 | 500 | Comparative Example |
| 50 | 8 | 7.7 | 27 | Yes | 13 | 4 | 550 | Example |
| 51 | 7 | 8.8 | 28 | Yes | 14 | 3 | 570 | Example |
| 52 | 6 | 11.1 | 31 | No | — | — | 600 | Example |
| 53 | 7 | 7.8 | 26 | Yes | 12 | 5 | 590 | Example |
| 54 | 7 | 8.8 | 31 | No | — | — | 620 | Comparative Example |
| 55 | 8 | 10.4 | 33 | Yes | 13 | 4 | 590 | Comparative Example |
| 56 | 9 | 5.3 | 27 | Yes | 15 | 3 | 590 | Example |
| 57 | 9 | 5.4 | 26 | No | — | — | 580 | Example |
| 58 | 6 | 5.1 | 29 | Yes | 12 | 2 | 560 | Example |
| 59 | 6 | 8.0 | 33 | Yes | 12 | 1 | 600 | Example |
| 60 | 7 | 7.9 | 28 | Yes | 12 | 5 | 570 | Example |

*Average in the temperature range of 750 to 650° C. in terms of surface temperature

**Surface temperature

***Average in the temperature range of 750 to 650° C. in terms of sheet thickness center temperature

****Sheet thickness center temperature

TABLE 4

| | | Hot rolled steel sheet | | | | | | | | Flat portion of square column | | | | | |
|---|---|---|---|---|---|---|---|---|---|---|---|---|---|---|---|
| | | Microstructure* | | | Tensile properties | | | | | Tensile properties | | | | | |
| Steel sheet No. | Steel No. | Type** | Mean crystal grain diameter (μm)*** | Second phase frequency | Yield Strength YS (MPa) | Tensile strength TS (MPa) | Yield ratio YR (%) | Toughness $vE_0$ (J) | Toughness $vE_{-30}$ (J) | Yield strength YS (MPa) | Tensile strength TS (MPa) | Yield ratio YR (%) | Toughness $vE_0$ (J) | Toughness $vE_{-30}$ (J) | Notes |
| 1 | A | F + P | 9.5 | 0.25 | 291 | 450 | 65 | 315 | 260 | 365 | 477 | 77 | 227 | 172 | Example |
| 2 | A | F + P | 9.8 | 0.27 | 302 | 446 | 68 | 300 | 237 | 375 | 467 | 80 | 242 | 178 | Example |
| 3 | A | F + P + B | 8.9 | 0.32 | 305 | 455 | 67 | 265 | 200 | 378 | 493 | 77 | 228 | 162 | Example |
| 4 | A | F + P | 19.2 | 0.36 | 265 | 444 | 60 | 187 | 152 | 341 | 460 | 74 | 62 | 27 | Comparative Example |
| 5 | A | F + P | 15.7 | 0.49 | 268 | 445 | 60 | 135 | 67 | 344 | 463 | 74 | 124 | 56 | Comparative Example |
| 6 | A | F + P | 14.9 | 0.35 | 277 | 445 | 62 | 245 | 185 | 352 | 462 | 76 | 223 | 150 | Example |
| 7 | A | F + P | 18.5 | 0.52 | 255 | 442 | 58 | 125 | 29 | 331 | 452 | 73 | 108 | 12 | Comparative Example |
| 8 | A | B | 17.5 | 0.12 | 397 | 462 | 86 | 347 | 332 | 465 | 512 | 91 | 183 | 166 | Comparative Example |
| 9 | A | F + P | 17.5 | 0.43 | 271 | 447 | 61 | 186 | 84 | 346 | 469 | 74 | 154 | 52 | Comparative Example |
| 10 | A | F + P | 15.0 | 0.46 | 282 | 449 | 63 | 153 | 66 | 356 | 475 | 75 | 116 | 29 | Comparative Example |
| 11 | A | B | 6.4 | 0.08 | 406 | 461 | 88 | 365 | 360 | 459 | 512 | 90 | 260 | 151 | Comparative Example |
| 12 | A | F + P | 20.2 | 0.48 | 262 | 439 | 60 | 126 | 45 | 338 | 445 | 76 | 96 | 15 | Comparative Example |
| 13 | B | F + P | 13.8 | 0.32 | 294 | 448 | 66 | 273 | 206 | 367 | 471 | 78 | 252 | 185 | Example |
| 14 | C | F + P | 11.2 | 0.34 | 306 | 450 | 68 | 252 | 182 | 379 | 479 | 79 | 223 | 152 | Example |
| 15 | D | F + P | 14.9 | 0.30 | 316 | 448 | 71 | 284 | 228 | 358 | 472 | 76 | 230 | 174 | Example |
| 16 | E | F + P | 6.3 | 0.09 | 377 | 457 | 82 | 378 | 375 | 460 | 499 | 92 | 199 | 195 | Comparative Example |
| 17 | F | F + P | 10.2 | 0.45 | 312 | 455 | 69 | 179 | 85 | 385 | 492 | 78 | 126 | 32 | Comparative Example |
| 18 | G | F + P | 9.5 | 0.25 | 228 | 423 | 54 | 317 | 273 | 305 | 395 | 77 | 220 | 175 | Comparative Example |
| 19 | H | F + P | 6.2 | 0.40 | 395 | 460 | 86 | 216 | 148 | 463 | 509 | 91 | 93 | 25 | Comparative Example |
| 20 | I | F + P | 10.8 | 0.25 | 327 | 456 | 72 | 235 | 197 | 371 | 495 | 75 | 193 | 155 | Example |
| 21 | J | F + P | 11.4 | 0.33 | 330 | 458 | 74 | 275 | 205 | 386 | 502 | 77 | 246 | 176 | Example |

TABLE 4-continued

| Steel sheet No. | Steel No. | Hot rolled steel sheet: Microstructure*: Type** | Mean crystal grain diameter (μm)*** | Second phase frequency | Tensile properties: Yield Strength YS (MPa) | Tensile strength TS (MPa) | Yield ratio YR (%) | Toughness: $vE_0$ (J) | $vE_{-30}$ (J) | Flat portion of square column: Tensile properties: Yield strength YS (MPa) | Tensile strength TS (MPa) | Yield ratio YR (%) | Toughness: $vE_0$ (J) | $vE_{-30}$ (J) | Notes |
|---|---|---|---|---|---|---|---|---|---|---|---|---|---|---|---|
| 22 | K | F + P | 12.7 | 0.39 | 337 | 456 | 72 | 225 | 205 | 393 | 497 | 79 | 186 | 166 | Example |
| 23 | L | F + P | 11.9 | 0.33 | 313 | 453 | 69 | 256 | 239 | 386 | 487 | 79 | 199 | 182 | Example |
| 24 | M | F + P | 6.1 | 0.16 | 430 | 532 | 81 | 323 | 298 | 506 | 555 | 91 | 289 | 269 | Comparative Example |
| 25 | N | F + P | 6.5 | 0.11 | 445 | 513 | 87 | 343 | 302 | 510 | 552 | 92 | 301 | 279 | Comparative Example |
| 26 | R | F + P | 9.3 | 0.26 | 343 | 473 | 73 | 260 | 218 | 397 | 498 | 80 | 227 | 178 | Example |
| 27 | S | F + P | 9.1 | 0.24 | 355 | 477 | 74 | 278 | 216 | 400 | 502 | 80 | 229 | 173 | Example |
| 28 | T | F + P | 11.8 | 0.37 | 343 | 467 | 73 | 263 | 234 | 412 | 490 | 79 | 226 | 191 | Example |
| 29 | U | F + P | 10.8 | 0.33 | 333 | 442 | 75 | 280 | 245 | 365 | 470 | 78 | 244 | 201 | Example |
| 30 | V | F + P | 7.4 | 0.32 | 349 | 485 | 72 | 297 | 253 | 407 | 511 | 80 | 250 | 202 | Example |

*¼ t sheet thickness position

**F: ferrite, P: pearlite, B: bainite

***Mean grain diameter of all crystal grains

TABLE 5

| Steel sheet No. | Steel No. | Hot rolled steel sheet: Microstructure*: Type** | Mean crystal grain diameter (μm)*** | Second phase frequency | Tensile properties: Yield Strength YS (MPa) | Tensile strength TS (MPa) | Yield ratio YR (%) | Toughness: $vE_0$ (J) | $vE_{-30}$ (J) |
|---|---|---|---|---|---|---|---|---|---|
| 31 | A | F + P | 9.0 | 0.24 | 290 | 448 | 65 | 316 | 260 |
| 32 | A | F + P | 9.2 | 0.23 | 300 | 446 | 67 | 303 | 238 |
| 33 | A | F + P + B | 8.2 | 0.24 | 303 | 450 | 67 | 268 | 202 |
| 34 | A | F + P | 18.4 | 0.36 | 261 | 442 | 59 | 190 | 153 |
| 35 | A | F + P | 15.3 | 0.54 | 266 | 443 | 60 | 137 | 69 |
| 36 | A | F + P | 14.1 | 0.30 | 274 | 442 | 62 | 247 | 188 |
| 37 | A | F + P | 18.0 | 0.53 | 254 | 442 | 58 | 125 | 31 |
| 38 | A | B | 16.7 | 0.18 | 394 | 457 | 86 | 348 | 334 |
| 39 | A | F + P | 17.1 | 0.49 | 267 | 445 | 60 | 188 | 86 |
| 40 | A | F + P | 14.7 | 0.55 | 261 | 445 | 59 | 155 | 68 |
| 41 | A | B | 5.5 | 0.04 | 404 | 460 | 88 | 368 | 361 |
| 42 | A | F + P | 20.1 | 0.53 | 258 | 435 | 59 | 127 | 46 |
| 43 | B | F + P | 12.9 | 0.25 | 293 | 447 | 65 | 274 | 207 |
| 44 | C | F + P | 10.8 | 0.30 | 301 | 448 | 67 | 252 | 182 |
| 45 | D | F + P | 14.6 | 0.22 | 311 | 446 | 70 | 286 | 228 |
| 46 | E | F + P | 6.3 | 0.17 | 374 | 455 | 82 | 378 | 377 |
| 47 | F | F + P | 9.7 | 0.53 | 308 | 453 | 68 | 182 | 88 |
| 48 | G | F + P | 9.0 | 0.22 | 225 | 422 | 53 | 319 | 275 |
| 49 | H | F + P | 6.2 | 0.37 | 390 | 455 | 86 | 218 | 150 |
| 50 | I | F + P | 10.5 | 0.24 | 325 | 453 | 72 | 236 | 198 |
| 51 | J | F + P | 11.0 | 0.32 | 327 | 456 | 72 | 277 | 205 |
| 52 | K | F + P | 12.6 | 0.38 | 335 | 452 | 74 | 225 | 206 |
| 53 | L | F + P | 11.7 | 0.35 | 313 | 449 | 70 | 258 | 240 |
| 54 | M | F + P | 6.0 | 0.15 | 428 | 529 | 81 | 323 | 300 |
| 55 | N | F + P | 6.2 | 0.11 | 442 | 511 | 87 | 345 | 304 |
| 56 | R | F + P | 9.0 | 0.25 | 335 | 463 | 72 | 251 | 205 |
| 57 | S | F + P | 8.9 | 0.23 | 347 | 467 | 74 | 268 | 209 |

TABLE 5-continued

| | | | | | | | | | |
|---|---|---|---|---|---|---|---|---|---|
| 58 | T | F + P | 12.9 | 0.38 | 335 | 457 | 73 | 254 | 225 |
| 59 | U | F + P | 11.2 | 0.34 | 325 | 432 | 75 | 272 | 236 |
| 60 | V | F + P | 7.6 | 0.33 | 341 | 475 | 72 | 289 | 245 |

| | Flat portion of square column | | | | | |
|---|---|---|---|---|---|---|
| | Tensile properties | | | Toughness | | |
| Steel sheet No. | Yield strength YS (MPa) | Tensile strength TS (MPa) | Yield ratio YR (%) | $vE_0$ (J) | $vE_{-30}$ (J) | Notes |
| 31 | 365 | 478 | 76 | 228 | 173 | Example |
| 32 | 376 | 469 | 80 | 244 | 179 | Example |
| 33 | 379 | 495 | 77 | 229 | 162 | Example |
| 34 | 341 | 460 | 74 | 64 | 28 | Comparative Example |
| 35 | 343 | 464 | 74 | 125 | 57 | Comparative Example |
| 36 | 350 | 464 | 76 | 225 | 150 | Example |
| 37 | 330 | 454 | 73 | 108 | 13 | Comparative Example |
| 38 | 464 | 514 | 90 | 185 | 169 | Comparative Example |
| 39 | 345 | 470 | 73 | 156 | 52 | Comparative Example |
| 40 | 437 | 485 | 90 | 116 | 149 | Comparative Example |
| 41 | 457 | 513 | 89 | 261 | 152 | Comparative Example |
| 42 | 336 | 445 | 76 | 97 | 15 | Comparative Example |
| 43 | 378 | 472 | 80 | 254 | 187 | Example |
| 44 | 379 | 480 | 79 | 224 | 153 | Example |
| 45 | 374 | 474 | 79 | 232 | 176 | Example |
| 46 | 462 | 500 | 92 | 200 | 195 | Comparative Example |
| 47 | 386 | 493 | 78 | 126 | 33 | Comparative Example |
| 48 | 305 | 396 | 77 | 220 | 176 | Comparative Example |
| 49 | 463 | 509 | 91 | 96 | 27 | Comparative Example |
| 50 | 373 | 496 | 75 | 193 | 155 | Example |
| 51 | 389 | 503 | 77 | 247 | 178 | Example |
| 52 | 394 | 499 | 79 | 187 | 167 | Example |
| 53 | 386 | 490 | 79 | 200 | 182 | Example |
| 54 | 509 | 558 | 91 | 291 | 269 | Comparative Example |
| 55 | 511 | 552 | 92 | 302 | 280 | Comparative Example |
| 56 | 395 | 507 | 78 | 221 | 156 | Example |
| 57 | 398 | 499 | 80 | 237 | 169 | Example |
| 58 | 379 | 488 | 78 | 220 | 152 | Example |
| 59 | 365 | 487 | 75 | 232 | 171 | Example |
| 60 | 430 | 508 | 85 | 245 | 188 | Example |

*¼ t sheet thickness position
**F: ferrite, P: pearlite, B: bainite
***Mean grain diameter of all crystal grains

The invention claimed is:

1. A method of manufacturing a hot rolled steel sheet for a square column for building structural members, comprising a hot rolling step, a cooling step, and a coiling step performed on a steel to form a hot rolled steel sheet, wherein the steel has a composition containing, in terms of % by mass,

| | |
|---|---|
| C: 0.07 to 0.18% | Mn: 0.3 to 1.5%, |
| P: 0.03% or less, | S: 0.015% or less, |
| Al: 0.01 to 0.06%, | N: 0.0006% or less, |

and the balance being Fe and unavoidable impurities, the hot rolling step includes heating the steel to 1100 to 1300° C., rough-rolling the heated steel at a rough rolling end temperature of 1150 to 950° C. to form a sheet bar, and finish-rolling the sheet bar at a finish rolling start temperature of 1100 to 850° C. and a finish rolling end temperature of 900 to 750° C. to form a hot rolled sheet, the cooling step is started immediately after completion of the finish rolling and includes controlling cooling to a coiling temperature such that (i) an average cooling rate at 750 to 650° C. in terms of surface temperature is 20° C./s or less and (ii) an average cooling rate at 750 to 650° C. at the sheet thickness center is 4 to 8° C./s and less than the average cooling rate at 750 to 650° C. in terms of surface temperature, and (iii) a time taken for a temperature at a sheet thickness center to reach 650° C. is within 35 s, and the coiling step includes coiling the cooled steel sheet at a coiling temperature of 500 to 650° C. and allowing the coiled sheet to cool.

2. The method according to claim 1, wherein finish rolling is performed at a total reduction of 35 to 70%.

3. The method according to claim 1, wherein the composition of the steel further comprises Si: less than 0.4% by mass.

4. The method according to claim 1, wherein the composition of the steel further comprises at least one selected from Nb: 0.015% or less, Ti: 0.030% or less, and V: 0.070% or less in terms of % by mass.

5. The method according to claim 1, wherein the composition of the steel further comprises B: 0.008% by mass or less.

6. A method of manufacturing a hot rolled steel sheet for a square column for building structural members, comprising a hot rolling step, a cooling step, and a coiling step performed on a steel to form a hot rolled steel sheet, wherein the steel has a composition containing, in terms of % by mass,

| | |
|---|---|
| C: 0.07 to 0.18% | Mn: 0.3 to 1.5%, |
| P: 0.03% or less, | S: 0.015% or less, |
| Al: 0.01 to 0.06%, | N: 0.0006% or less, |

and the balance being Fe and unavoidable impurities, the hot rolling step includes heating the steel to 1100 to 1300° C., rough-rolling the heated steel at a rough rolling end temperature of 1150 to 950° C. to form a sheet bar, and finish-rolling the sheet bar at a finish rolling start temperature of 1100 to 850° C. and a finish rolling end temperature of 900 to 750° C. to form a hot rolled sheet, the cooling step is started immediately after completion of the finish rolling and includes three stages of cooling, which are first cooling, second cooling, and third cooling so that a time taken for a temperature at a sheet thickness center to reach 650° C. is within 35 s from the start of cooling, wherein the first cooling includes performing cooling so that a cooling end temperature is 550° C. or more in terms of surface temperature, the second cooling includes performing air cooling for 3 to 15 s after completion of the first cooling, and the third cooling includes performing cooling to a temperature of 650° C. or less at an average cooling rate of 4 to 15° C./s at 750 to 650° C. in terms of the temperature at the sheet thickness center after completion of the second cooling, and the coiling step includes coiling the cooled steel sheet at a coiling temperature of 500 to 650° C. and allowing the coiled sheet to cool.

7. The method according to claim 6, wherein fourth cooling is performed after completion of the third cooling in addition to the three stages of the cooling.

8. The method according to claim 6, wherein a total reduction of the finish rolling is 35 to 70%.

9. The method according to claim 6, wherein the composition of the steel further comprises Si: less than 0.4% by mass.

10. The method according to claim 6, wherein the composition of the steel further comprises at least one selected from Nb: 0.015% or less, Ti: 0.030% or less, and V: 0.070% or less in terms of % by mass.

11. The method according to claim 6, wherein the composition of the steel further comprises B: 0.008% by mass or less.

* * * * *